US006256907B1

(12) United States Patent
Jordan et al.

(10) Patent No.: US 6,256,907 B1
(45) **Date of Patent: *Jul. 10, 2001**

(54) ATHLETIC SHOE WITH RETRACTABLE SPIKES

(75) Inventors: J. Charles Jordan, Charlotte, NC (US); Clark S. Smith, Greenville, SC (US)

(73) Assignee: Retractable, Inc., Greenville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/390,396

(22) Filed: Sep. 3, 1999

Related U.S. Application Data

(63) Continuation-in-part of application No. 09/059,859, filed on Apr. 14, 1998, now Pat. No. 5,946,828.

(51) Int. Cl.[7] ..... A43C 15/00; A43C 15/08

(52) U.S. Cl. ..... 36/61; 36/67 D; 36/134

(58) Field of Search ..... 36/61, 62, 134, 36/65, 67 D, 67 R, 67 A, 59 B, 131

(56) References Cited

U.S. PATENT DOCUMENTS

| | | | | |
|---|---|---|---|---|
| 264,105 | | 9/1882 | Rust . | |
| 351,415 | | 10/1886 | Weller . | |
| 659,615 | | 10/1900 | Bowen . | |
| 2,034,050 | | 3/1936 | Levy . | |
| 2,070,269 | | 2/1937 | Goldenberg . | |
| 3,526,976 | | 9/1970 | Jacobs . | |
| 3,693,271 | | 9/1972 | Korpei . | |
| 3,717,238 | | 2/1973 | Fox . | |
| 3,739,497 | | 6/1973 | Cameron . | |
| 3,782,011 | | 1/1974 | Fisher . | |
| 3,793,751 | | 2/1974 | Gordos . | |
| 4,035,934 | * | 7/1977 | Hrivnak | 36/134 |
| 4,375,729 | | 3/1983 | Buchanen, III . | |
| 4,644,672 | * | 2/1987 | Dassler et al. | 36/134 |
| 4,712,318 | * | 12/1987 | Greiner et al. | 36/134 |
| 4,825,562 | | 5/1989 | Chuang . | |
| 5,269,080 | | 12/1993 | Davis . | |
| 5,299,369 | | 4/1994 | Goldman . | |
| 5,737,855 | | 4/1998 | Jordan et al. . | |
| 5,946,828 | * | 9/1999 | Jordan et al. | 36/134 |

FOREIGN PATENT DOCUMENTS

| | | | | |
|---|---|---|---|---|
| 1261017 | * | 2/1968 | (DE) | 36/61 |
| 1 438 333 | | 6/1976 | (GB) . | |

* cited by examiner

*Primary Examiner*—M. D. Patterson
(74) *Attorney, Agent, or Firm*—Adams, Schwartz & Evans, P.A.

(57) ABSTRACT

A spiked athletic shoe includes a shoe upper and an outsole housing connected to the shoe upper. The outsole housing includes a bottom having a plurality of spike openings. Spaced-apart rear and front spike plates are positioned within the outsole housing and include a plurality of spikes attached for movement between a spike-extended position through the spike openings and a spike-retracted position. Springs engage the rear and front spike plates for normally urging the rear and front spike plates and attached spikes upwardly into the spike-retracted position. A mechanically-actuated slide overlies the rear and front spike plates for controlling movement of the spike plates between the spike-retracted position and the spike-extended position.

21 Claims, 6 Drawing Sheets

ATHLETIC SHOE WITH RETRACTABLE SPIKES

TECHNICAL FIELD AND BACKGROUND OF THE INVENTION

This application is a continuation-in-part of U.S. Ser. No. 09/059,859 filed on Apr. 14, 1998, now U.S. Pat. No. 5,946,828.

The invention relates to an athletic shoe with retractable spikes, and is most applicable for use by golfers, although other application to sports and activities using spiked shoes is foreseeable. For example, the shoe may be used for baseball, football, hiking, logging, and the like. The invention includes means readily operable by the wearer for lifting the spikes into a retracted position within the shoe outsole, and for lowering the spikes into an extended position. When wearing the shoes on hard surfaces or easily damaged surfaces, such as parking lots, sidewalks, wood floors, or clubhouse floors, it is generally desirable to position the spikes in the retracted position.

Conventional spiked golf shoes suffer from drawbacks and limitations. Since the spikes are secured in a fixed condition directly to the bottom surface of the shoe outsole, they remain in constant contact with the ground surface during wear. In addition to damage caused by these shoes to hard floor surfaces, the spikes can also damage the putting greens of the golf course. As a result, there exists a need for a spiked athletic shoe wherein the spikes can be quickly and easily moved and retained in a retracted position within the shoe during wear.

The present invention addresses this need by providing a golf shoe with retractable spikes. The spikes are fully retractable within the outsole of the shoe, and remain in this position during wear until actuated by the wearer into the extended position.

SUMMARY OF THE INVENTION

Therefore, it is an object of the invention to provide a spiked athletic shoe wherein the spikes are easily movable by the wearer between a spike-extended position and a retracted position within an outsole of the shoe.

It is another object of the invention to provide a spiked athletic shoe which will not damage golf greens or club house floors during shoe wear.

It is another object of the invention to provide a spiked athletic shoe which can be worn on hard surfaces without substantial risk of accidents and injury.

It is another object of the invention to provide a spiked athletic shoe which uses permanent, wear-resistant spikes.

It is another object of the invention to provide a spiked athletic shoe which is flexible and comfortable to wear.

It is another object of the invention to provide a spiked athletic shoe which will not collect dirt and debris inside the shoe during wear.

It is another object of the invention to provide a spiked athletic shoe which resembles a conventional golf shoe.

It is another object of the invention to provide a spiked athletic shoe which includes a relatively thin outsole compared to other athletic shoes having retractable spikes.

It is another object of the invention to provide a spiked athletic shoe which includes at least one moveable spike plate.

These and other objects of the present invention are achieved in the preferred embodiments disclosed below by providing a spiked athletic shoe which includes a shoe upper and an outsole housing connected to the shoe upper. The outsole housing includes a bottom having a plurality of spike openings. Spaced-apart rear and front spike plates are positioned within the outsole housing and include a plurality of attached spikes for movement between a spike-extended position, wherein the plurality of spikes project outwardly from the bottom of the outsole housing, and a spike-retracted position, wherein the plurality of spikes are retracted within the outsole housing. Biasing means engage the rear and front spike plates for normally urging the rear and front spike plates and attached spikes upwardly into the spike-retracted position.

A mechanically-actuated slide overlies the rear and front spike plates for controlling movement of the spike plates between the spike-retracted position and the spike-extended position. The slide includes a plurality outwardly projecting detents. The rear and front spike plates include a corresponding plurality of complementary detent-receiving plate openings. The plurality of detents and plate openings cooperate upon movement of the slide such that upon mating alignment of the detents and plate openings, whereby the detents extend entirely through the openings, the biasing means moves the rear and front spike plates and attached spikes upwardly into the spike-retracted position away from the bottom of the outsole housing. Upon offsetting the detents and plate openings, the rear and front spike plates and attached spikes move downwardly towards the bottom of the outsole housing into the spike-extended position, and remain locked in the spike-extended position during shoe wear.

According to one preferred embodiment of the invention, a support cap is placed over the outsole housing and includes front and rear flanges for supporting the foot of a wearer above the slide and spike plates, and for defining a space for movement of the spike plates within the outsole housing between the spike-retracted position and the spike-extended position.

According to another preferred embodiment of the invention, a manual crank is attached to the slide and includes an arm section extending outside of the outsole housing for being manually actuated by the wearer to move the slide within the outsole between a toe end and a heel end of the shoe.

According to yet another preferred embodiment of the invention, the slide includes a center bearing secured to an underside of the slide for receiving a center-bearing section of the crank.

According to yet another preferred embodiment of the invention, the support cap includes laterally spaced, stationary side bearings for receiving respective side-bearing sections of the crank on opposite sides of the slide.

According to yet another preferred embodiment of the invention, the support cap includes a laterally extending flex groove to allow flexing of the support cap with the shoe during wear.

According to yet another preferred embodiment of the invention, the front spike plate includes a laterally extending flex groove to allow flexing of the front spike plate with the shoe during wear.

According to yet another preferred embodiment of the invention, the biasing means are springs located between the bottom of the outsole housing and the rear and front spike plates for normally urging the rear and front spike plates and attached spikes upwardly into the spike-retracted position.

According to yet another preferred embodiment of the invention, the springs are conical to minimize their height when fully compressed.

According to yet another preferred embodiment of the invention, each spike includes a cylindrical, straight shank portion.

According to yet another preferred embodiment of the invention, each spike includes a ceramic tip.

According to yet another preferred embodiment of the invention, respective seals are located at the spike openings of the outsole housing to prevent entry of dirt and debris inside the shoe.

According to yet another preferred embodiment of the invention, the seals are rubber collars each having top and bottom annular flanges. The respective flanges prevent the seals from being dislodged from the outsole housing during movement of the spikes between the extended and retracted positions.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
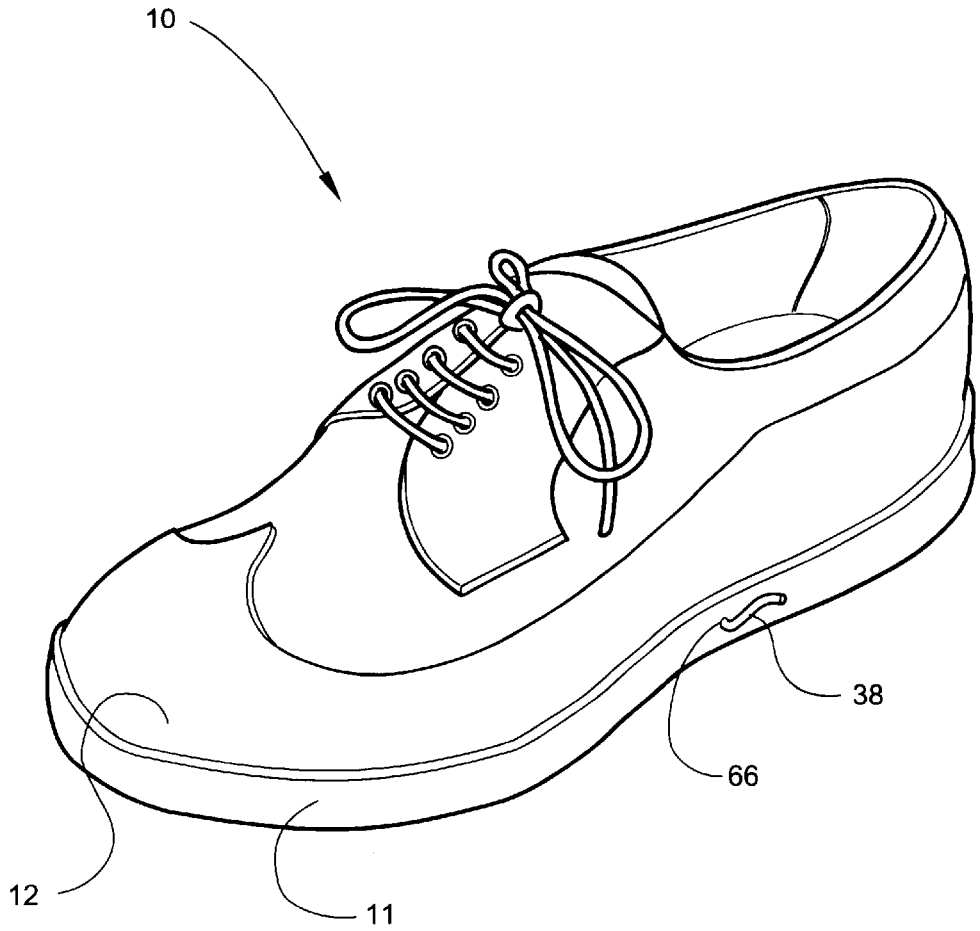
FIG. 1 is a perspective view of a spiked athletic shoe according to one preferred embodiment of the invention.

Referring now specifically to the drawings, a spiked athletic shoe according to the present invention is illustrated in FIG. 1 and shown generally at reference numeral 10. The spiked shoe 10 is intended primarily for use by golfers, although designs embodying the invention for other applications are foreseeable. The spiked shoe 10 includes an outsole housing 11 and a shoe upper 12. The shoe upper 12 is attached to the outsole housing 11 in a conventional manner and is constructed of any suitable material, such as leather.

Figure 2:
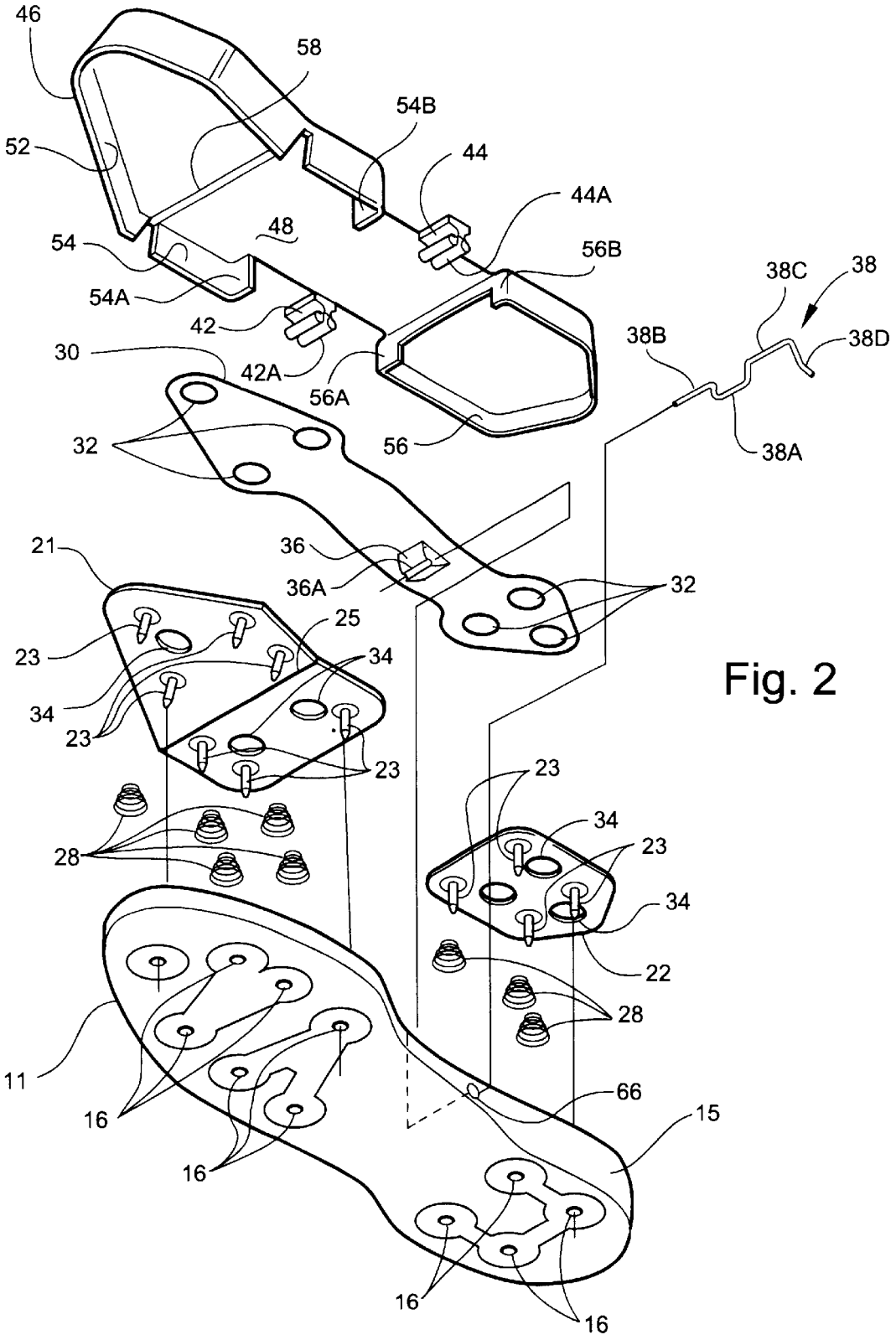
FIG. 2 is an exploded view of the outsole housing and interior components of the spiked shoe.
Figure 3:
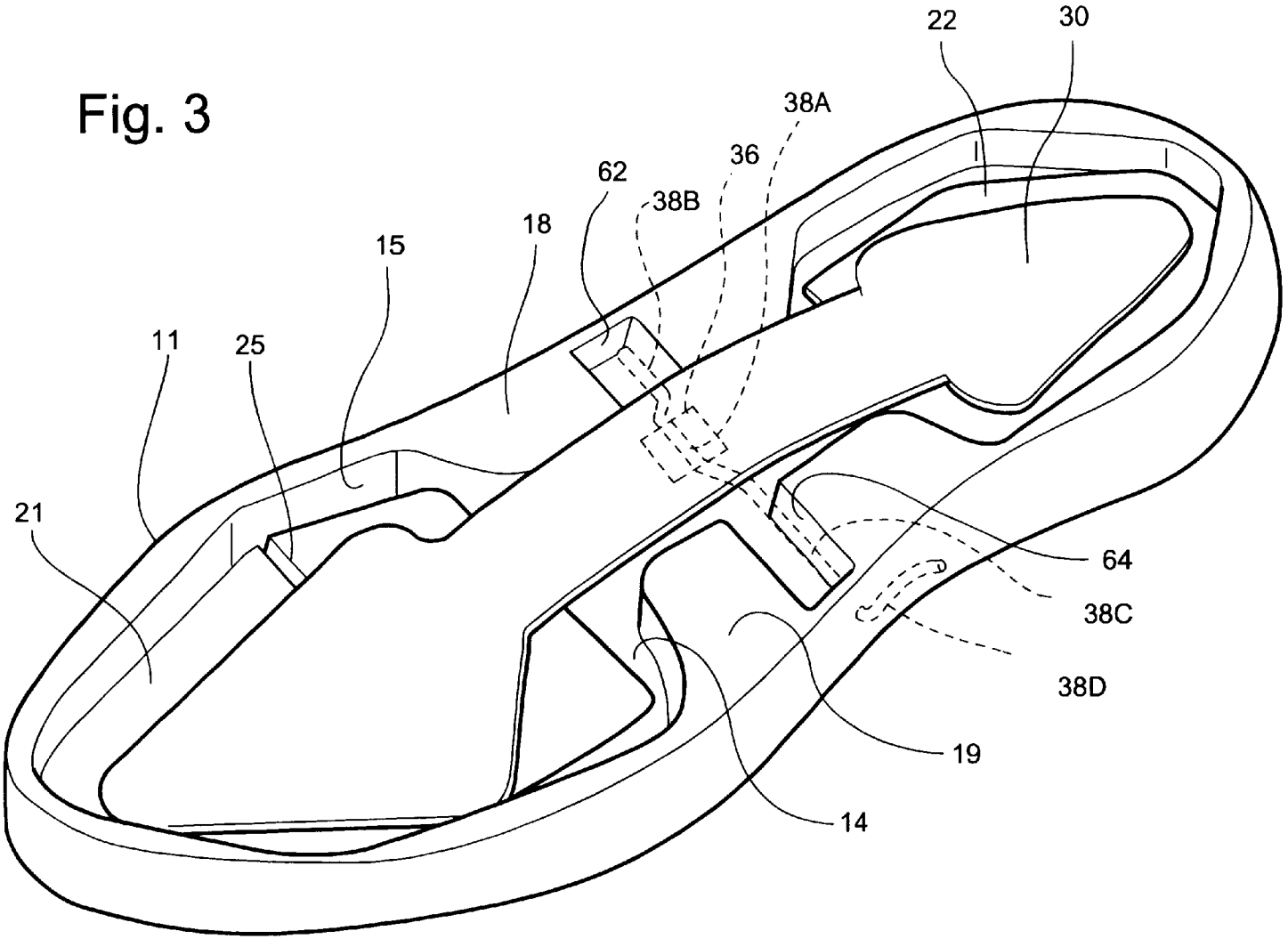
FIG. 3 is a perspective view of the slide and spike plates as positioned in the outsole housing.

The outsole housing 11 and internal components of the spiked shoe 10 are best illustrated in FIGS. 2 and 3. The outsole housing 11 is preferably formed of a thermoplastic polyurethane material, and includes a recessed bottom 14 and integrally-formed upstanding sides 15. The bottom 14 is relatively thin and includes a number of spike openings 16. The thickness of the bottom 14 is preferably about 0.20 inches. The sides 15 are relatively narrow along the rear and front portions of the outsole housing 11, and curve inwardly at a center portion of the outsole housing 11 to define laterally spaced mid-sections 18 and 19 of wider dimension.

Front and rear spike plates 21 and 22 formed of a rigid material, such as carbon reinforced plastic, reside within the outsole housing 11 between the sides 15 and include outwardly projecting spikes 23. The front spike plate 21 preferably includes a laterally-extending flex groove 25 to allow flexing of the front plate 21 with the shoe 10 during wear. As described further below, the spike plates 21 and 22 are readily movable by the wearer between a spike-extended position and a spike-retracted position, shown in FIGS. 5 and 7, respectively. The thickness of each spike plate 21 and 22 is about 0.10 inches.

Figure 4:
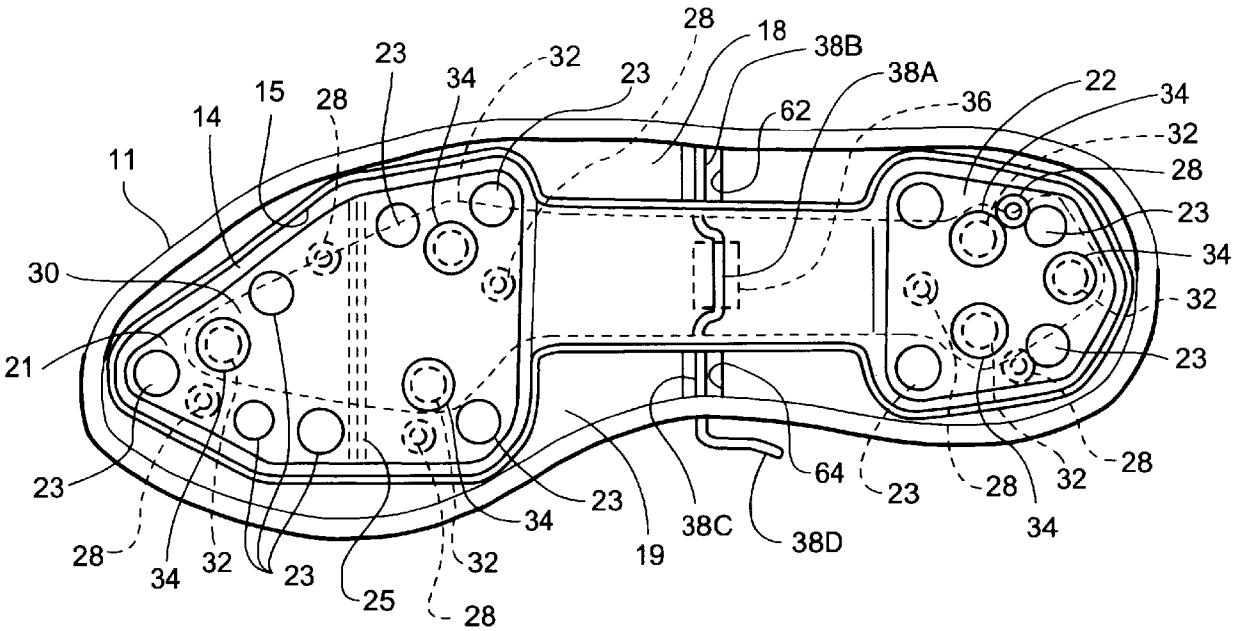
FIG. 4 is a top plan view of the outsole housing with the support cap removed, and showing slide in phantom shifted towards the heel end of the shoe such that the detents are in substantial vertical alignment with the openings of the spike plates.

Conical springs 28, or other biasing means, such as leaf springs or resilient foam inserts, are located between the bottom 14 of the outsole housing 11 and the spike plates 21 and 22 for normally urging the spike plates 21, 22 and attached spikes 23 upwardly into the spike-retracted position shown in FIG. 4.

A flexible slide 30 is positioned in overlying relation to the spike plates 21 and 22, and includes a number of protruding, solid detents 32 for being selectively aligned with and offset from corresponding plate openings 34 formed in the spike plates 21 and 22. The slide 30 and detents 32 are preferably integrally molded of a carbon reinforced plastic material. The thickness of the slide 30 is about 0.035 inches, and the height of the detents 32 about 0.250 inches.

Figure 5:
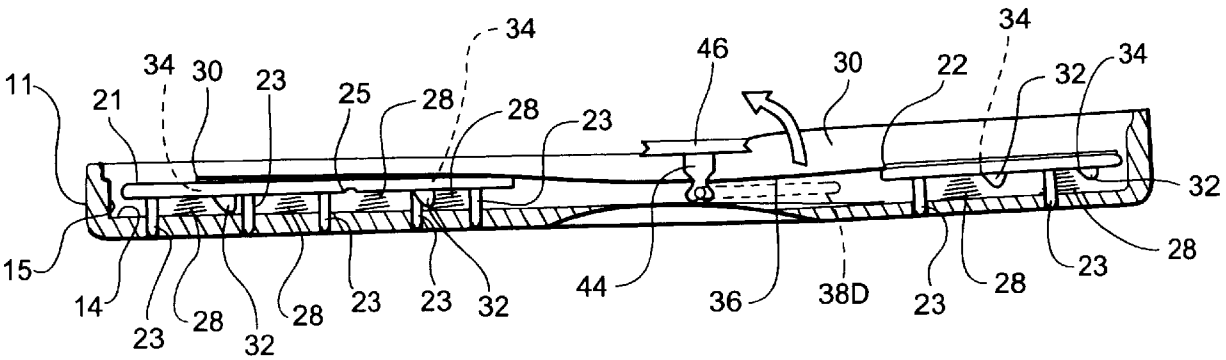
FIG. 5 is a longitudinal cross-sectional view of the outsole housing with the spike plates and attached spikes in the spike-retracted position, and showing a fragmentary portion of the support cap and the side bearing with the position of the crank indicated in phantom.
Figure 6:
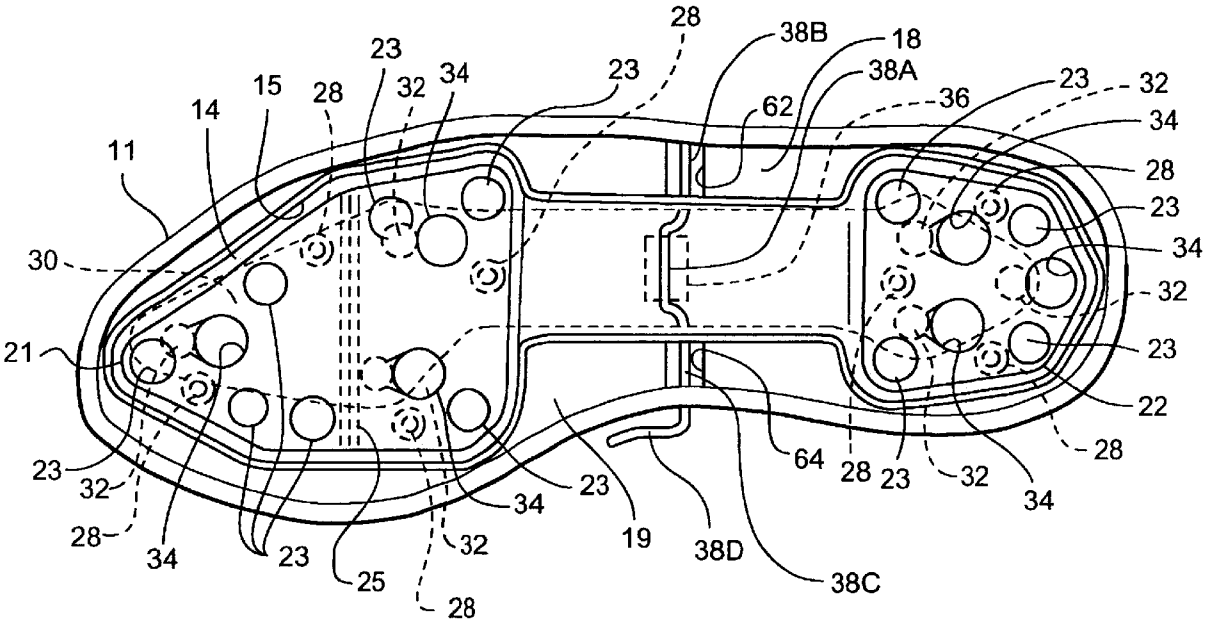
FIG. 6 is a top plan view of the outsole housing with the support cap removed, and showing slide in phantom shifted towards the toe end of the shoe such that the detents are off-set from the openings of the spike plates.
Figure 7:
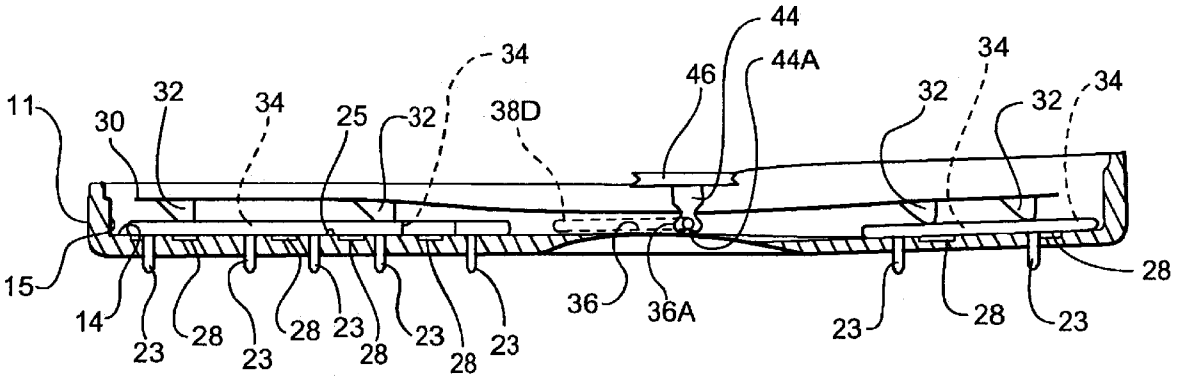
FIG. 7 is a longitudinal cross-sectional view of the outsole housing with the spike plates and attached spikes in the spike-extended position, and showing a fragmentary portion of the support cap and the side bearing with the position of the crank indicated in phantom.

When the detents 32 and openings 34 are in vertical mating alignment, as shown in FIGS. 4 and 5, the springs 28 force the spike plates 21, 22 and attached spikes 23 upwardly away from the bottom 14 of the outsole housing 11 and into the spike-retracted position. The detents 32 preferably extend entirely through the plate openings 34. When offset from the plate openings 34, as shown in FIGS. 6 and 7, the detents 32 of the slide 30 force the spike plates 21 and 22 downwardly against the bottom 14 of the outsole housing 11 to move the spikes 23 into the spike-extended position.

As best shown in FIGS. 2 and 3, a center bearing 36 is molded to the underside of the slide 30 and cooperates with a manual steel crank 38 used to move the slide 30 in a lengthwise direction between the heel end and toe end of the shoe 10. The center bearing 36 includes a locking channel 36A which receives an elongate center-bearing section 38A of the crank 38. The locking channel 36A allows rotation of the crank 38 in the bearing 36 and provides a convenient snap attachment for securing the crank 38 to the slide 30.

Opposed, stationary side bearings 42 and 44, shown in FIG. 2, are molded with a support cap 46 and include respective locking channels 42A and 44A adapted for receiving side-bearing sections 38B and 38C of the crank 38 on opposite sides of the slide 30. The support cap 46 includes a rigid top 48 and molded front, middle, and rear flanges 52, 54, and 56 which cooperate to support the foot of the wearer above the slide 30 and spike plates 21 and 22, and to define a space for movement of the spike plates 21 and 22 within the outsole housing 11 between the spike-retracted position and the spike-extended position. The middle and rear flanges 54 and 56 include respective inwardly-turned ends 54A, 54B and 56A, 56B for providing reinforced support. The front of the support cap 46 preferably includes a flex groove 58 extending laterally across the cap 46 between adjacent ends of the front and middle flanges 52 and 54. The flex groove 58 allows flexing of the support cap 46 with the shoe 10 during wear.

The support cap 46 fits over the outsole housing 11 to position the side bearings 42 and 44 in respective cut-outs 62 and 64 (See FIG. 3) formed in mid-sections 18 and 19 of the outsole housing 11, and to snap attach the locking channels 42A and 44A onto the crank 38. The side-bearing sections 38B and 38C of the crank 38 are coaxial and extend generally parallel to the integrally formed center-bearing section 38A. An angled, integrally formed arm section 38D of the crank 38 passes through a hole 66 in the outsole housing 11 and extends outside of the housing 11 generally perpendicular to the side-bearing section 38C for being manually actuated by the wearer to move the slide 30 within the shoe 10, as described below.

FIGS. 4–7, illustrate operation of the slide 30 and movement of the front and rear spike plates 21 and 22 from the spike-retracted position to the spike-extended position. As shown in FIGS. 4 and 5, the detents 32 of the slide 30 and openings 34 of the front and rear spike plates 21 and 22 are in substantial vertical alignment. Springs 28 urge the spike plates 21, 22 and attached spikes 23 upwardly into the spike-retracted position. To move the spike plates 21, 22 downwardly into the spike-extended position, the wearer manually pivots the arm section 38D of the crank 38 in a counterclockwise direction indicated in FIG. 5.

The crank 38 and center bearing 36 attached to the slide 30 cooperate to shift the slide 30 towards the toe end of the shoe 10. As the detents 32 slide out of the openings 34 and engage the spike plates 21 and 22, the slide 30 bears against an inside surface of the top 48 of the support cap 46. The detents 32 force the spike plates 21 and 22 downwardly against the biasing force of the springs 28. As shown in FIGS. 6 and 7, The detents 32 of the slide 30 are entirely offset from the plate openings 34, and act to maintain the spike plates 21, 22 and attached spikes 23 in the spike-extended position during shoe wear. The conical springs 28 are fully compressed.

To return the spike plates 21 and 22 to the spike-retracted position, the wearer pivots the crank 38 substantially 180° in a reverse, clockwise direction. The slide 30 shifts towards the heel end of the shoe 10, and the detents 32 realign with the openings 34 of the spike plates 21 and 22. The springs 28 again urge the spike plates 21, 22 and attached spikes 23 upwardly away from the bottom 14 of the outsole housing 11 and into their fully retracted position.

Preferably, the attached spikes 23 of the spike plates 21 and 22 are permanent, wear-resistant, straight-shank metal spikes with ceramic tips which do not require repair or replacement during the life of the shoe. The length of each spike 23 is preferably about 0.50 inches, and its diameter about 0.15 inches.

Figure 8:
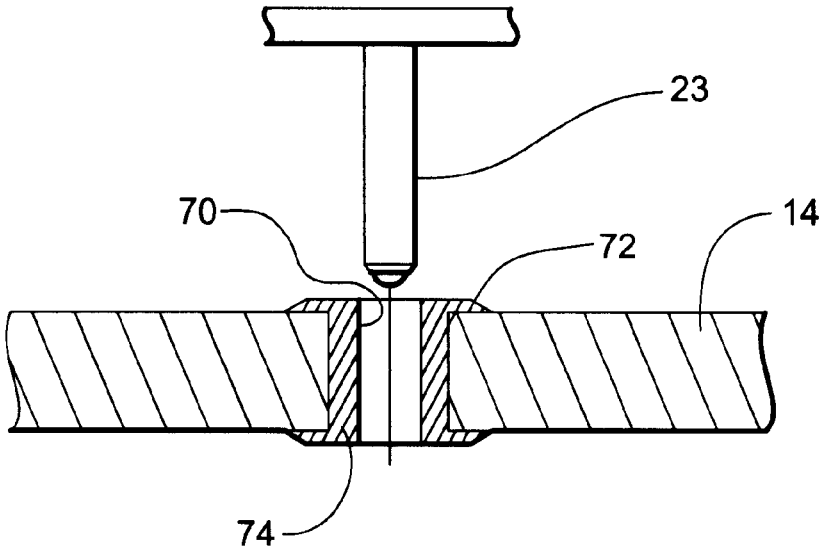
FIG. 8 is a fragmentary cross-sectional view of the outsole housing taken at one of the spike openings to show the collar seal for preventing debris from entering the shoe during wear.
Figure 9:
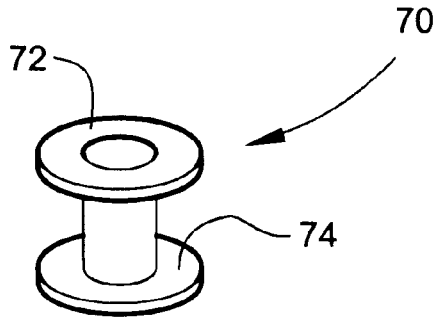
FIG. 9 is a perspective view of the collar seal.

As shown in FIGS. 8 and 9, in order to prevent dirt and debris from entering the shoe 10 through the bottom 14 of the outsole housing 11, rubber collars 70 are preferably molded with the outsole housing 11 at the spike openings 16. The rubber collars 70 have a diameter substantially equal to the diameter of the spikes 23, such that the spikes 23 cooperate with the collars 70 to form a seal against entry of dirt and debris in both the extended and retracted positions. Each collar 70 further includes integrally formed top and bottom flanges 72 and 74 which prevent the collar 70 from being dislodged from the spike opening 16 as the spike 23 is moved between the extended and retracted position.

A spiked athletic shoe is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A spiked athletic shoe, comprising:

(a) a shoe upper;

(b) an outsole housing connected to the shoe upper and including a bottom having a plurality of spike openings therein;

(c) a spike plate positioned within said outsole housing and including a plurality of spikes attached thereto for movement between a spike-extended position, wherein said plurality of spikes project through the spike openings outwardly from the bottom of said outsole housing, and a spike-retracted position, wherein said plurality of spikes are retracted within said outsole housing;

(d) biasing means engaging said spike plate for normally urging said spike plate and attached spikes upwardly into the spike-retracted position;

(e) a mechanically-actuated slide overlying said spike plate for controlling movement of the spike plate between the spike-retracted position and the spike-extended position, wherein the slide includes a plurality outwardly projecting detents, and wherein said spike plate include a corresponding plurality of complementary detent-receiving plate openings, said plurality of detents and plate openings cooperating upon movement of the slide such that:

(i) upon mating alignment of the detents and plate openings, whereby the detents extend through the openings, said biasing means moves said spike plate and attached spikes upwardly into the spike-retracted position away from the bottom of said outsole housing; and (ii) upon offsetting the detents and plate openings, said spike plate and attached spikes move downwardly towards the bottom of said outsole housing into the spike-extended position, and remain locked in the spike-extended position during shoe wear; and (f) a support cap for being placed over the outsole housing and including front and rear flanges for supporting the foot of a wearer above the slide and spike plate, and to define a space for movement of the spike plate within the outsole housing between the spike-retracted position and the spike-extended position.

2. A spiked athletic shoe according to claim 1, and comprising a manual crank attached to the slide, and including an arm section extending outside of the outsole housing for being manually actuated by the wearer to move the slide within the outsole between a toe end and a heel end of the shoe.

3. A spiked athletic shoe according to claim 2, wherein the slide includes a center bearing secured to an underside thereof for receiving a center-bearing section of the crank.

4. A spiked athletic shoe according to claim 3, wherein the support cap includes laterally spaced, fixed side bearings for receiving respective side-bearing sections of the crank on opposite sides of the slide.

5. A spiked athletic shoe according to claim 1, wherein the support cap includes a laterally extending flex groove to allow flexing of the support cap with the shoe during wear.

6. A spiked athletic shoe according to claim 1, wherein the spike plate includes a laterally extending flex groove to allow flexing of the spike plate with the shoe during wear.

7. A spiked athletic shoe according to claim 1, wherein said biasing means comprises springs located between the bottom of said outsole housing and the spike plate for normally urging the spike plate and attached spikes upwardly into the spike-retracted position.

8. A spiked athletic shoe according to claim 7, wherein the springs are conical to minimize their height when fully compressed.

9. A spiked athletic shoe according to claim 1, wherein each spike includes a cylindrical, straight shank portion.

10. A spiked athletic shoe according to claim 1, wherein each spike includes a ceramic tip.

11. A spiked athletic shoe according to claim 1, and including respective seals located at the spike openings of the outsole housing to prevent entry of dirt and debris inside the shoe.

12. A spiked athletic shoe according to claim 11, wherein the seals comprise rubber collars each having top and bottom annular flanges to prevent the seals from being dislodged from the outsole housing during movement of the spikes between the extended and retracted positions.

13. A spiked athletic shoe, comprising:

(a) a shoe upper;

(b) an outsole housing connected to the shoe upper and including a bottom having a plurality of spike openings therein;

(c) a spike plate positioned within said outsole housing and including a laterally extending flex groove to allow flexing of the spike plate with the shoe during wear, said spike plate having a plurality of spikes attached thereto for movement between a spike-extended position, wherein said plurality of spikes project through the spike openings outwardly from the bottom of said outsole housing, and a spike-retracted position, wherein said plurality of spikes are retracted within said outsole housing;

(d) biasing means engaging said spike plate for normally urging said spike plate and attached spikes upwardly into the spike-retracted position;

(e) a mechanically-actuated slide overlying said spike plate for controlling movement of the spike plate between the spike-retracted position and the spike-extended position, wherein the slide includes a plurality outwardly projecting detents, and wherein said spike plate include a corresponding plurality of complementary detent-receiving plate openings, said plurality of detents and plate openings cooperating upon movement of the slide such that:

(i) upon mating alignment of the detents and plate openings, whereby the detents extend through the openings, said biasing means moves said spike plate and attached spikes upwardly into the spike-retracted position away from the bottom of said outsole housing; and (ii) upon offsetting the detents and plate openings, said spike plate and attached spikes move downwardly towards the bottom of said outsole housing into the spike-extended position, and remain locked in the spike-extended position during shoe wear.

14. A spiked athletic shoe according to claim 13, and comprising a manual crank attached to the slide, and including an arm section extending outside of the outsole housing for being manually actuated by the wearer to move the slide within the outsole between a toe end and a heel end of the shoe.

15. A spiked athletic shoe according to claim 14, wherein the slide includes a center bearing secured to an underside thereof for receiving a center-bearing section of the crank.

16. A spiked athletic shoe according to claim 13, wherein said biasing means comprises springs located between the bottom of said outsole housing and the spike plate for normally urging the spike plate and attached spikes upwardly into the spike-retracted position.

17. A spiked athletic shoe according to claim 16, wherein the springs are conical to minimize their height when fully compressed.

18. A spiked athletic shoe according to claim 13, wherein each spike includes a cylindrical, straight shank portion.

19. A spiked athletic shoe according to claim 13, wherein each spike includes a ceramic tip.

20. A spiked athletic shoe according to claim 13, and including respective seals located at the spike openings of the outsole housing to prevent entry of dirt and debris inside the shoe.

21. A spiked athletic shoe according to claim 20, wherein the seals comprise rubber collars each having top and bottom annular flanges to prevent the seals from being dislodged from the outsole housing during movement of the spikes between the extended and retracted positions.

* * * * *